United States Patent [19]

Roesler

[11] Patent Number: 4,510,696

[45] Date of Patent: Apr. 16, 1985

[54] SURVEYING OF BOREHOLES USING SHORTENED NON-MAGNETIC COLLARS

[75] Inventor: Richard F. Roesler, Houston, Tex.

[73] Assignee: NL Industries, Inc., New York, N.Y.

[21] Appl. No.: 515,716

[22] Filed: Jul. 20, 1983

[51] Int. Cl.[3] ..... E21B 47/022

[52] U.S. Cl. ..... 33/304; 33/313

[58] Field of Search ..... 33/304, 302, 303, 312, 33/313

[56] References Cited

U.S. PATENT DOCUMENTS

| | | | |
|---|---|---|---|
| 3,862,499 | 1/1975 | Isham et al. | 33/302 |
| 3,935,642 | 2/1976 | Russell | 33/312 |
| 4,021,774 | 5/1977 | Asmundsson et al. | 33/313 |
| 4,071,959 | 2/1978 | Russell et al. | 33/313 |
| 4,083,117 | 4/1978 | Russell et al. | 33/313 |
| 4,163,324 | 8/1979 | Russell et al. | 33/313 |
| 4,199,869 | 4/1980 | Van Steenwyk | 33/304 |

FOREIGN PATENT DOCUMENTS

| | | | |
|---|---|---|---|
| 2086055 | 5/1982 | United Kingdom | 33/304 |

*Primary Examiner*—Willis Little

*Attorney, Agent, or Firm*—Carl O. McClenny; William E. Johnson, Jr.

[57] ABSTRACT

When surveying a borehole using an instrument responsive to the earth's magnetic field, a length of non-magnetic drill collar is necessary to house means for measuring the magnetic field in the borehole perpendicular to the direction of the borehole axis. The instrument determines the inclination angle and the highside angle from the gravitation measurements, with these measurements and the magnetic measurements, the azimuth angle is determined. Using the method of this invention a minimum length of non-magnetic material necessary for an accurate measurement may be calculated and used.

4 Claims, 8 Drawing Figures

SURVEYING OF BOREHOLES USING SHORTENED NON-MAGNETIC COLLARS

This invention relates to the surveying of boreholes and to the use of a shorter nonmagnetic drill collar for housing the surveying instrumentation. It is particularly concerned with the determination of the azimuth angle of a borehole using a shorter nonmagnetic drill collar.

At present "pivoted compass" single shot and multi-shot instruments are used for determination of azimuth angle. However, with such instruments, the necessary correction to compensate for the modification of the earth's magnetic field in the vicinity of the instruments can only be performed by assuming the size and direction of the error field caused by the instrument, requiring a knowledge of the magnetic moment of the compass magnet and using instrumentation located in a nonmagnetic drill collar having a minimum length of 30 feet and in some areas of the world, as much as 120 feet. The procedure for determination of the azimuth angle is necessarily empirical and use of the lengthy nonmagnetic collar is troublesome.

In Russell et al., U.S. Pat. No. 4,163,324, there is disclosed a method for determination of the azimuth angle of a borehole in which it is assumed that the error vector which modifies the earth's magnetic vector at the instrument is in the direction of the borehole at the survey location. The instrument can be mounted in a nonmagnetic housing in the form of a drill collar with the other components of the drill string above and below the instrument being typically constructed of magnetic materials. The effect of this assumption is that the magnitude of the error vector can be determined from the difference between the true and apparent values of the components of the earth's magnetic field in a single direction which is not perpendicular to the axis of the borehole.

In the method of Russel et al. for determining the orientation of the surveying instrument in the borehole, the steps include determining the inclination angle of the instrument at the location thereof in the borehole, sensing, at said location, at least one vector component of the local magnetic field to determine the local magnetic field in the direction of a primary axis of the instrument aligned with the borehole, determining the azimuth angle of the instrument relative to the apparent magnetic north direction at said location, ascertaining the true horizontal and vertical components of the earth's magnetic field at the location of the borehole and determining the correction to be applied to the apparent azimuth angle from the true and apparent values for the horizontal and vertical components of the earth's magnetic field.

According to the invention of this Application, there is provided an improved method for determining the orientation of a surveying instrument in a borehole including the steps of determining the inclination angle of the instrument at the location in the borehole, determining the high side angle of the instrument at the location, determining the true horizontal and vertical components of the earth's magnetic field at the location, determining the components of the local magnetic field perpendicular to the longitudinal axis of the instrument at the location, determining the azimuth angle for the instrument relative to the apparent magnetic north direction at the location.

The inclination and highside angles are preferably determined by measuring the gravity vector at the instrument. This may be done using three accelerometers which are preferably orthogonal to one another and are conveniently arranged such that two of them sense the components of gravity in the two directions that the fluxgates sense the components of the local magnetic field.

In another embodiment of this application, a system positioned in a drill collar is disclosed for determining the orientation of a downhole instrument in a borehole comprising: means for determining inclination angle of the instrument at a location in the borehole; means for determining the highside angle of the instrument at the location; means for determining the true horizontal and vertical components of the earth's magnetic field at the borehole; means for determining two components of the local magnetic field perpendicular to the direction of the longitudinal axis of the instrument at the location, means for determining the azimuth angle of the instrument relative to magnetic north directed at the location, the drill collar being constructed of nonmagnetic material, and having a minimum length, L, which is determined by:

$$L = 2\left[\frac{|P_U| + |P_L|\ 2d}{4\pi\ B_n\ \delta\psi}\right]^{\frac{1}{3}}$$

The determination of the azimuth angle of an instrument in a borehole, in accordance with the invention, will now be described in more detail with reference to the accompanying drawings in which.

Figure 1:
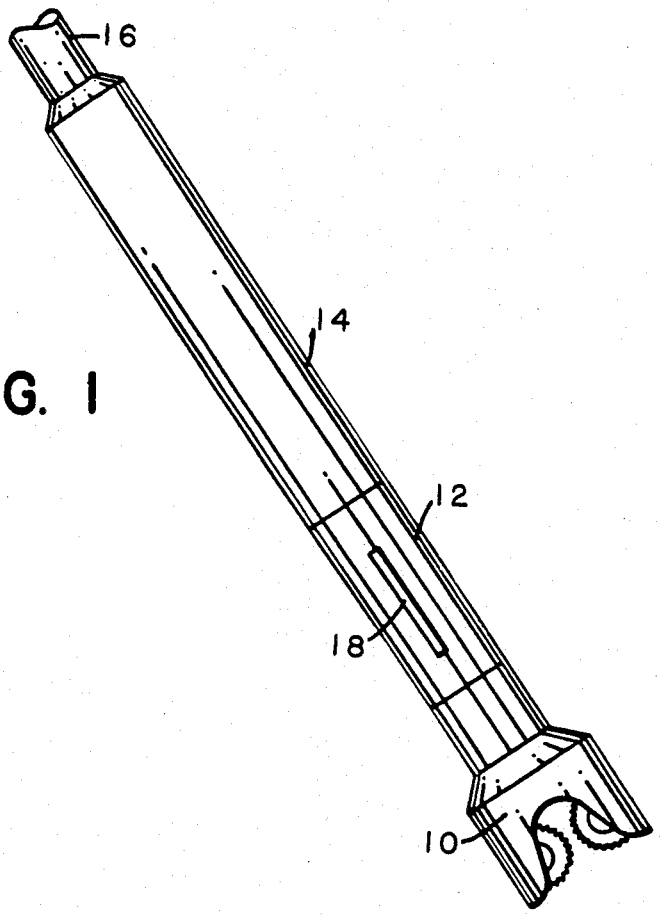
FIG. 1 is a schematic elevational view of a drill string incorporating a survey instrument in accordance with the invention.
Figure 6:
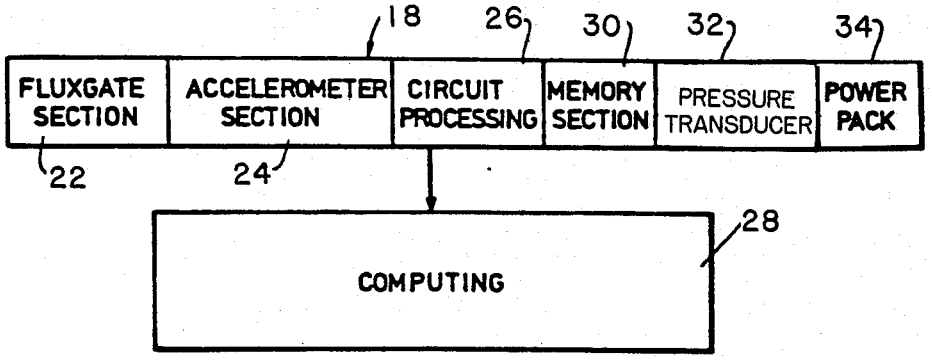
FIG. 6 is a block schematic diagram illustrating the instrument shown in FIG. 1.

Referring to FIG. 1, a drill string comprises a drilling bit 10 which is coupled by a nonmagnetic drill collar 12 and a set of drill collars 14, which may be made of magnetic material, to a drill string or pipe 16. The nonmagnetic drill collar 12 of a predetermined length contains a survey instrument 18 in accordance with the invention. As shown in FIG. 6, the survey instrument 18 comprises a fluxgate section 22 and an accelerometer section 24. The accelerometer section 24 comprises three acceleratometers arranged to sense components of gravity in three mutually orthogonal directions, once of which is preferably coincident with the longitudinal axis of the drill string. The fluxgate section 22 comprises two fluxgates arranged to measure magnetic field strength in two of the three mutually orthogonal directions namely along axes OX and OY as will be described with reference to FIG. 2. Additionally, the survey instrument comprises associated signal processing apparatus as will be described hereinafter with reference to FIG. 6.

The instrument sensors measure local field components within a "nonmagnetic" drill collar 12 which is itself part of the drill string, the collar being located close to the drilling bit 10. The outputs from the two mutually orthogonal fluxgates comprise the components $B_x$ and $B_y$ of the local magnetic field along the axes OX and OY respectively. The outputs from the three accelerometers in the accelerometer section 24 comprise the components $g_x$, $g_y$, and $g_z$ of the local gravitation field along the axes OX, OY and OZ.

The five output components $g_x$,$g_y$,$B_x$, and $B_y$ and By are in the form of proportional voltages which are applied to a circuit processing unit 26 comprising analog to digital converters. The outputs $g_x$,$g_y$, and $g_z$ from the anlog to digital converters in the circuit processing unit 26 are ultimately processed through a digital computing unit 28 to yield values of highside angle $\phi$ and inclination $\theta$. This computing operation may be performed within the survey instrument and the computed values stored in a memory section 30 which preferably comprises one or more solid-state memory packages. However, instead of storing four values $\phi$, $\theta$, $B_x$ and $B_y$ it will usually be more convenient to provide the memory section 30 with sufficient capacity to store the five outputs from the analog to digital converters in the circuit processing unit 26 and to provide the computing unit 28 in the form of a separate piece of apparatus to which the instrument is connected after extraction from the borehole. Alternatively, the values may be directly transferred to the surface units via conventional telemetry means (not shown).

The instrument 18 may also comprise a pressure transducer 32 arranged to detect the cessation of pumping of drilling fluids through the drill string, this being indicative that the survey instrument is stationary. The measurements are preferably made when the instrument is stationary. Other means of detecting the nonmovement of the instrument may be used such as motion sensors.

Power for the instrument may be supplied by a battery power pack 34, downhole power generator or power line connected with a surface power supply unit.

The preferred form of the invention, using two fluxgates and three accelerometers as described above, has the advantage of not requiring any accurately pivoted components, the only moving parts being the proof masses of the accelerometers.

Figure 2:
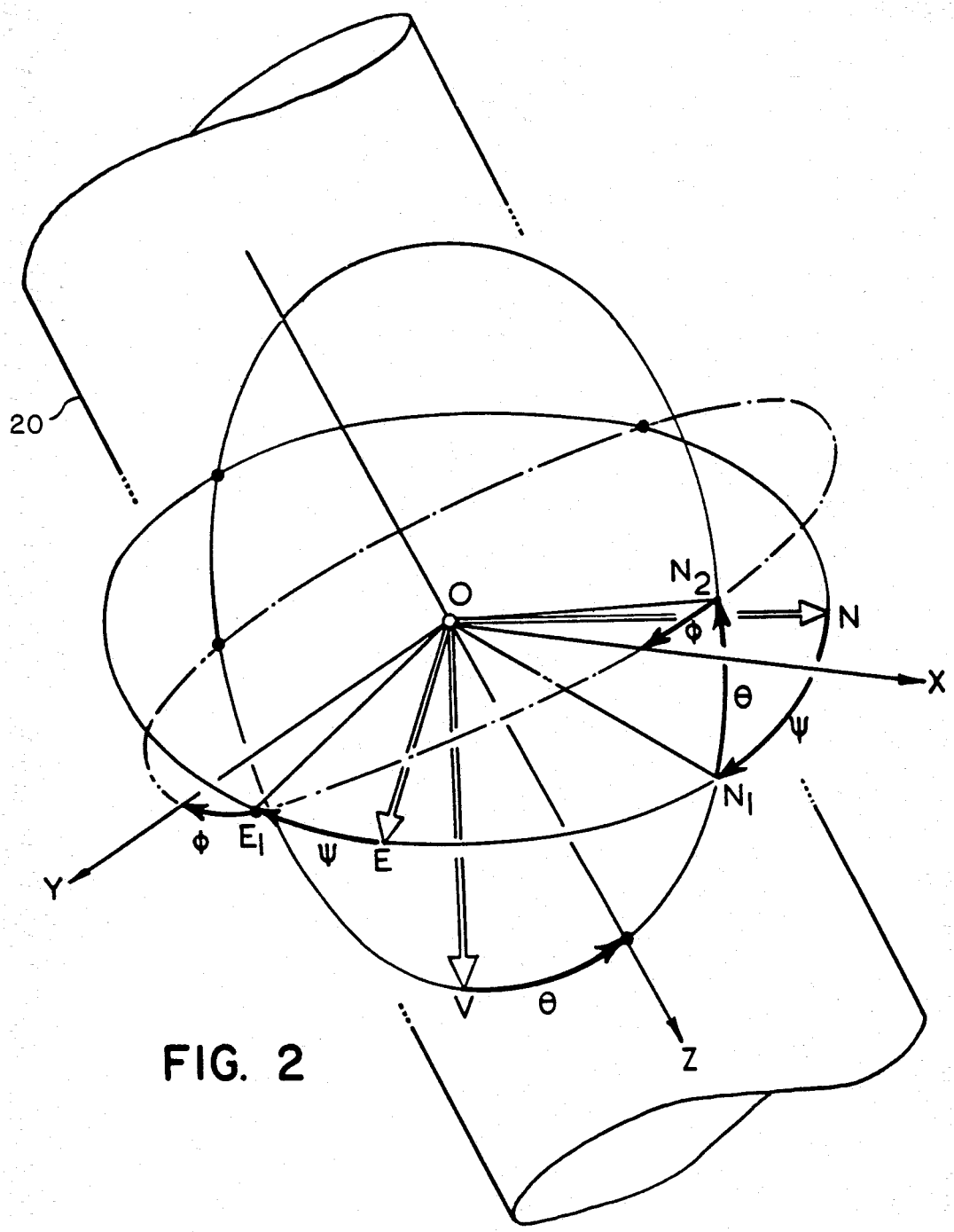
FIG. 2 is a schematic perspective view illustrating a transformation between earth-fixed axes and instrument-fixed axes.

FIG. 2 shows a borehole 20 and illustrates various reference axes relative to which the orientation of the borehole 20 may be defined. A set of earth-fixed axes (ON, OE and OV) are illustrated with OV being vertically down and ON being a horizontal reference position. A corresponding instrument-case-fixed set of axes OX, OY and OZ are illustrated where OZ is the longitudinal axis of the borehole (and therefore of the instrument case) and OX and OY, which are in a plane perpendicular to the borehole axis represented by a chain-dotted line, are the two above-mentioned directions in which the accelerometers and fluxgates are oriented.

Figure 3:
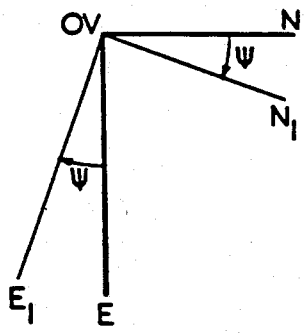
FIGS. 3 to 5 are diagrams illustrating, in two dimensions, the various stages of the transformation shown in FIG. 2.
Figure 4:
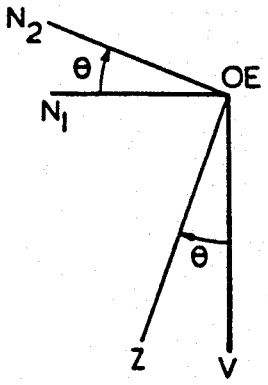
Figure 5:
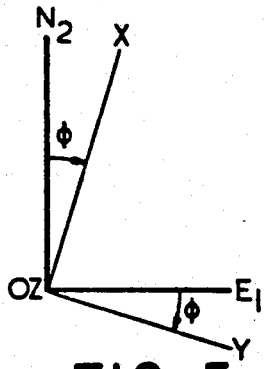

A spatial survey of the path of a borehole is usually derived from a series of measurements of an azimuth angle $\psi$ and an inclination angle $\theta$. Measurements of ($\theta$, $\psi$) are made at successive stations along the path, and the distance between these stations is accurately known. The set of case-fixed orthogonal axes OX, OY and OZ are related to an earth-fixed set of axes ON, OE and OV through a set of angular rotations ($\psi$, $\theta$, $\phi$). Specifically, the earth-fixed set of axes (ON, OE, OV) rotates into the case-fixed set of axes (OX, OY, OZ) via three successive clockwise rotations; through the azimuth angle $\psi$ about OV shown in FIG. 3; through the inclination angle $\theta$, about OE shown in FIG. 4; and through the highside angle $\phi$, about OZ shown in FIG. 5. In $U_N$, $U_E$ and $U_V$ are unit vectors in the ON, OE and OV directions respectively, then the vector operation equation is:

$$U_{NEV}=[\psi][\theta][\phi]U_{XYZ} \tag{1}$$

which represents the transformation between unit vectors in the two frames of reference (ONEV) and OXYZ) where:

$$[\psi] = \begin{matrix} \cos\psi & -\sin\psi & 0 \\ \sin\psi & \cos\psi & 0 \\ 0 & 0 & 1 \end{matrix} \tag{2}$$

$$[\theta] = \begin{matrix} \cos\theta & 0 & \sin\theta \\ 0 & 1 & 0 \\ -\sin\theta & 0 & \cos\theta \end{matrix} \tag{3}$$

$$[\phi] = \begin{matrix} \cos\phi & -\sin\phi & 0 \\ \sin\phi & \cos\phi & 0 \\ 0 & 0 & 1 \end{matrix} \tag{4}$$

The vector operation equation for a transformation in the reverse direction can be written as, $$U_{XYZ}=(\phi)^T(\Theta)^T(\psi)^T U_{NEV} \tag{5}$$

The computing operation performed by the computing unit 28 will now be described. The first stage is to calculate the inclination angle $\theta$ and the highside angle $\phi$. Use of the vector operation equation 5 to operate on the gravity vector;

$$\begin{bmatrix} O \\ O \\ g \end{bmatrix} \tag{6}$$

yields gravity components in the OXYZ frame $$g_x=-g\sin\theta\cos\phi \tag{7}$$

$$g_y=g\sin\theta\sin\phi \tag{8}$$

$$g_z=g\cos\theta \tag{9}$$

Thus, the highside angle $\phi$ can be determined from $$\tan\phi=-[g_y/g_x] \tag{10}$$

The next step is to obtain the value of $B_n$ and $B_v$, the true horizontal and vertical components of the earth's magnetic field, respectivey, from published geomagnetic survey data. If geomagnetic survey data is not available, the probe itself may be used to measure $B_n$ and $B_v$ the measurement being made at a location close to the top of the borehole but sufficiently remote from any ferromagnetic structure which may cause the true earth's magnetic field to be modified.

The azimuth angle, $\psi$, is calculated using an iteration loop the input values being the highside angle $\phi$, inclination angle $\theta$, and the magnetic field components $B_x$, $B_y$, and $B_n$. The initial value of azimuth angle, $\theta o$, is calculated from:

$$\tan\psi o = \frac{-(B_x \sin\phi + B_y \cos\phi)\cos\theta}{(B_x \cos\phi - B_y \sin\phi) + B_v \sin\theta} \quad (11)$$

Successive values of azimuth angle, $\psi n$, may be used to determine $B_z$ by equation:

$$B_z = B_n \cos\psi_n \sin\theta + B_v \cos\theta \quad (12)$$

Using $B_z$, the azimuth angle, $\psi$, may be determined using the equation $$\tan\psi\, n + 1 = \frac{(B_x \sin\phi + B_y \cos\phi)}{\cos\theta\,(B_x \cos\phi - B_y \sin\phi) + B_z \sin\theta} \quad (13)$$

Equations (12) and (13) are convenient to mechanize in a computing step until $(\psi_{n+1} - \psi_n)$ approaches a small preselected value. Measurement of the local magnetic and gravitational field components in the instrument case-fixed frame thus provides sufficient information to determine the azimuth value.

Figure 8:
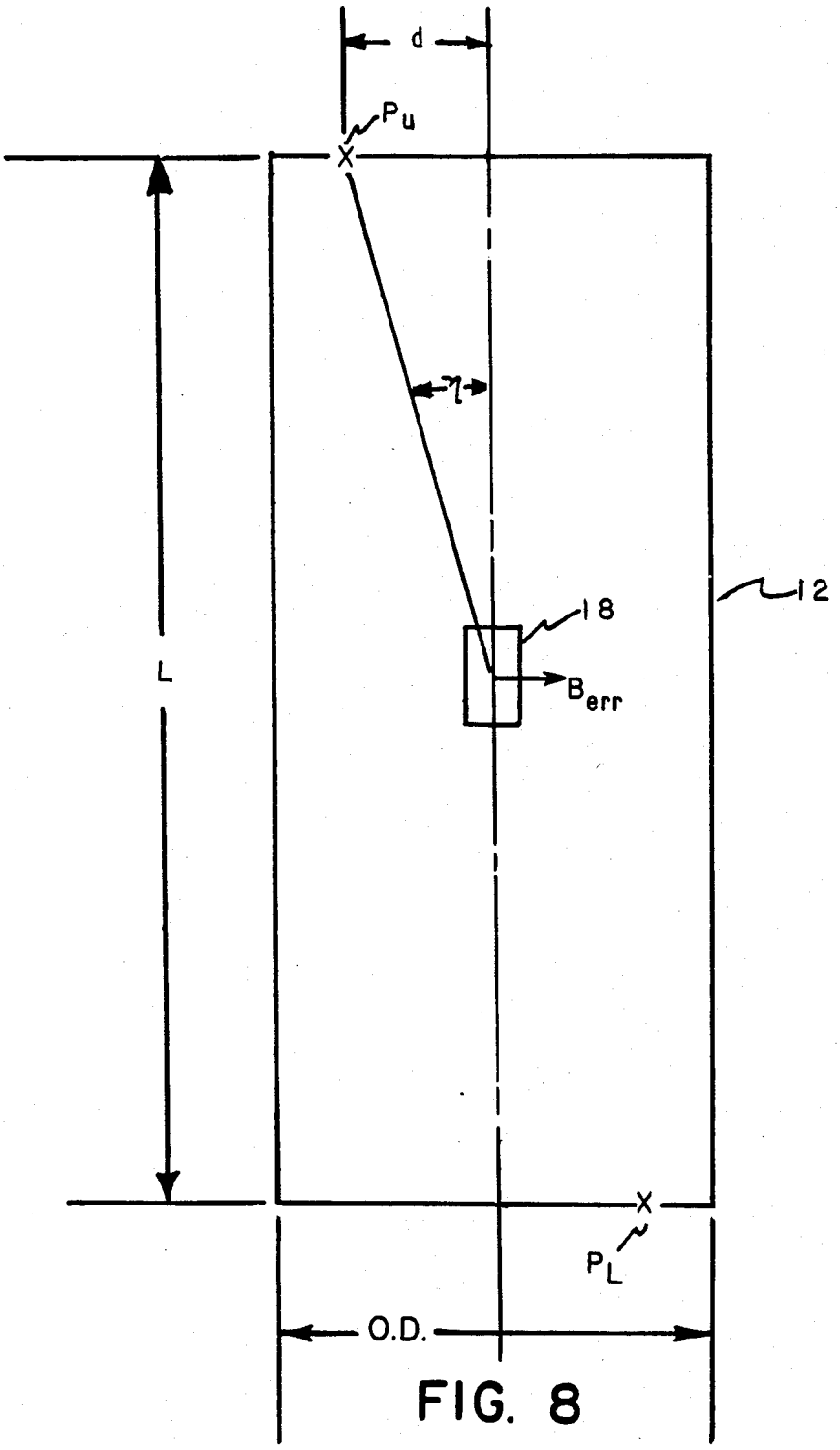
FIG. 8 is a schematic view of the survey instrument located in a drilling collar.

The length of the nonmagnetic drill collar may be determined as a function of the tolerable transverse error field $B_{err}$, as shown in FIG. 8 in which survey instrument 18 is located within the drill collar 12 having a minimum length, L, and an outer diameter, OD. The transverse field error will be created by the proximity of the magnetic material in the drill string 16 above and the drill collar or bit 10 below. The magnetic material of these two sources will create poles, $P_U$ and $P_L$, respectively. In the worst case, the poles may be assumed to be displaced from center by $$d = OD/600 \quad (14)$$

The transverse error field may be determined by $$Berr = \left[\frac{|P_U| + |P_L|}{4\pi\,(L/2)^2}\right] \sin\eta \quad (15)$$

where $\eta$ is the angle between the axis and the poles having a vertex at the survey instrument 18. Therefore:

$$\text{Sin}\ \eta = d/(L/2) = 2/d/L \quad (16)$$

The error caused in the azimuth angle in radians is determined by expanding the azimuth angle in a Taylor series as a function of the transverse field ($B_t$).

$$\psi = \psi(B_t) = \psi(^\circ)(B_t)\,(B_t) + \frac{\partial\psi}{B_t}\,(\text{Berr})$$

$$= \psi^\circ + \partial\psi$$

Therefore, the error in azimuth, $\delta\psi$, is given by $$\delta\psi = (\psi\delta/\delta B_t)\ B_{err} \quad (18)$$

By definition, $$B_t^2 = B_T^2 - B_z^2$$

Therefore:

$$B_t(\psi B_t/\delta\psi) = -B_z(\delta B_z/\delta\psi) \quad (19)$$

$B_t$ is approximately constant between about 20,000 and 60,000 $\mu$t as determined from (for example) pages 75–76 of the U.S. Geological Survey publication by E. B. Fabiano, N. W. Peddie. D. R. Barraclough and A. Zunde entitled "International Geomagnetic Reference Field 1980: Charts and Grid Values".

From Equation (12), $$\delta B_z/\delta\psi = -B_n \sin\psi \sin\theta \quad (20)$$

Using average values, $\langle B_z/B_t \rangle \approx 1$, $$\langle \sin\psi \rangle = \frac{1}{\sqrt{2}}$$

$$\langle \sin\theta \rangle = \frac{1}{\sqrt{2}}$$

then $$\delta B_t/\delta\psi = B_n/2 \quad (21)$$

By definition, $B_{err} = (\delta B_t/\delta\psi)\delta\psi$ (21)

From equation (21)

$$B_{err} = (B_n/2)\delta\psi \quad (22)$$

From Equation (16), $$\frac{B_n\,\delta\psi}{2} = \left[\frac{|P_U| + |P_L|\,(d)}{4\pi\,(L/2)^3}\right] \quad (23)$$

Solving equation (23) for L, $$L = 2\left[\frac{(|P_U| + |P_L|)\,2d}{4\pi\,B_n\,\delta\psi}\right]^{\frac{1}{3}} \quad (24)$$

For $|P_U| + |_L| = 2000$ micro Webers and a collar having an outer diameter of $7\frac{1}{2}''$, d, from equation (14), equals 0.013 in. Equation (14) may vary slightly with configuration of collar.

For an acceptable error in azimuth angle, $\psi$, of 0.25 degrees in the Gulf Coast, the minimum nonmagnetic collar length is L=6.4 ft.

Figure 7:
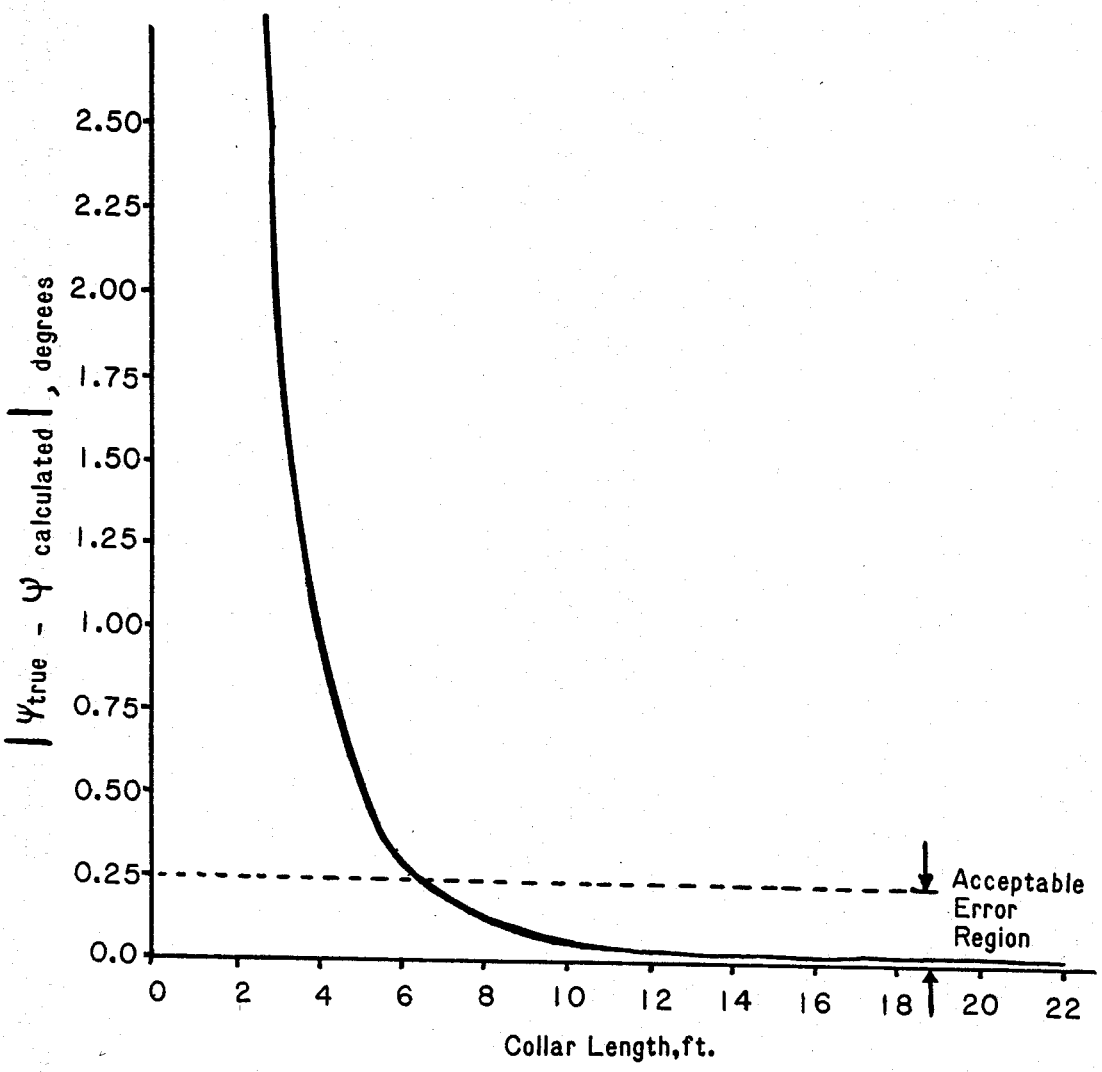
FIG. 7 illustrates typical error in calculated azimuth as a function of collar length for the Gulf Coast region.

FIG. 7 illustrates the error incurred in the calculation of azimuth angle as a function of collar length, L, for $B_n$ equals 25 micro Tesla, a value for the Gulf Coast region. As the length of non-magnetic collar is increased, the extraneous transverse magnetic field strength is reduced and the calculated azimuth approaches the true azimuth.

Therefore a minimum L of between about 5 to 7 feet will result in a calculated azimuth angle falling within the acceptable error region of FIG. 7 for the Gulf Coast. Other collar lengths will be calculated accordingly for different regions, collar configuration and outside diameter.

Using this determination, a system of this invention for determining the orientation of a downhole instrument in a borehole would comprise a means for determining inclination angle of the instrument at a location thereof in said borehole; a means for determining the highside angle of said instrument at said location; a means for determining the true horizontal and vertical components of the earth's magnetic field at the location of the borehole; a means for determining components of the local magnetic field perpendicular to the direction of a primary axis of the instrument aligned with the borehole at said location, said drill collar being constructed of non-magnetic material, and having a minimum length, L, determined as follows:

$$L = 2\left[\frac{|P_U| + |P_L|\ (2d)}{2\pi\ B_n\ \delta\psi}\right]^{\frac{1}{3}}$$

Numerous variations and modifications may obviously be made in the apparatus herein described without departing from the present invention. Accordingly, it should be clearly understood that the forms of the invention described herein and shown in the figures of the accompanying drawings are illustrative only and are not intended to limit the scope of the invention.

What is claimed is:

1. A system for determining the orientation of a downhole instrument positioned in a drill collar in a borehole comprising: a means for determining inclination angle of the instrument at a location thereof in said borehole; a means for determining the highside angle of said instrument at said location; a means for determining the true horizontal and vertical components of the earth's magnetic field at the location of the borehole; a means for determining components of the local magnetic field perpendicular to the direction of a primary axis of the instrument aligned with the borehole at said location, said drill collar being constructed of non-magnetic material, and having a minimum length, L, determined from the equation:

$$L = 2\left[\frac{(|Pu| + |PL|)2d}{4\pi\ Bn\ \delta\psi}\right]^{\frac{1}{3}}$$

where $P_u$ is the magnetic pole created by the magnetic material above the sensor, $P_L$ is the magnetic pole created by the magnetic material below the sensor, d is the displacement of the poles $P_u$ and $P_L$ from the axis of the instrument, $B_n$ is the North component of the earth's magnetic field at the tinstrument, and $\delta\psi$ is the error in the azimuth angle.

2. The orientation system of claim 1 wherein said means for determining the components of local magnetic field comprises a means for sensing measured components of said local magnetic field, said sensing means being located at least one third of said length of said drill collar from an end of said drill collar.

3. The orientation system of claim 1 wherein said instrument is located in a drill string extending in said borehole, said system being located between the lower drill string end connecting to the drill bit and an upper drill string end connecting to the surface.

4. The orientation system of claim 3 wherein said drill string is comprised of magnetic material.

* * * * *